US010288091B2

(12) United States Patent
Jirgal et al.

(10) Patent No.: US 10,288,091 B2
(45) Date of Patent: May 14, 2019

(54) ULTRASONIC DISPLACEMENT MEASUREMENT SYSTEM AND METHOD FOR ULTRASONIC DISPLACEMENT MEASUREMENT

(71) Applicant: HYDAC ELECTRONIC GMBH, Saarbruecken (DE)

(72) Inventors: Mathias Leo Jirgal, Saarbruecken (DE); Joerg Steffensky, Dillingen (DE); Horst Mannebach, Saarbruecken (DE); Thomas Hahn-Jose, St. Ingbert (DE)

(73) Assignee: HYDAC ELECTRONIC GMBH, Saarbruecken (DE)

( * ) Notice: Subject to any disclaimer, the term of this patent is extended or adjusted under 35 U.S.C. 154(b) by 407 days.

(21) Appl. No.: 14/895,018

(22) PCT Filed: Apr. 12, 2014

(86) PCT No.: PCT/EP2014/000982
§ 371 (c)(1),
(2) Date: Dec. 1, 2015

(87) PCT Pub. No.: WO2014/194973
PCT Pub. Date: Dec. 11, 2014

(65) Prior Publication Data

US 2016/0123356 A1 May 5, 2016

(30) Foreign Application Priority Data

Jun. 6, 2013 (DE) ..... 10 2013 009 614

(51) Int. Cl.
*F15B 15/28* (2006.01)
*F15B 1/24* (2006.01)

(52) U.S. Cl.
CPC ..... *F15B 15/2884* (2013.01); *F15B 1/24* (2013.01); *F15B 2201/205* (2013.01); *F15B 2201/31* (2013.01); *F15B 2201/515* (2013.01)

(58) Field of Classification Search
CPC ..... F15B 15/2884
See application file for complete search history.

(56) References Cited

U.S. PATENT DOCUMENTS 4,542,652 A 9/1985 Reuter et al.
4,938,054 A * 7/1990 Dye ..... G01B 17/00 73/1.21

(Continued)

FOREIGN PATENT DOCUMENTS

DE 87 02 817 5/1987
DE 101 37 988 2/2003

(Continued)

OTHER PUBLICATIONS

International Search Report (ISR) dated Aug. 7, 2014 in International (PCT) Application No. PCT/EP2014/000982.

*Primary Examiner* — Clayton E. LaBalle
*Assistant Examiner* — Dennis Hancock
(74) *Attorney, Agent, or Firm* — Wenderoth, Lind & Ponack, L.L.P.

(57) ABSTRACT

An ultrasonic displacement measurement system for hydraulic accumulators (3) has a movable separating element (5) separating two media chambers (9, 11) from each other in a media-tight manner within a housing (7). One media chamber (9) holds a compressible fluid or an incompressible fluid. The other media chamber (11) holds a compressible working gas. The particular position of the movable separating element (5) within the housing (7) can be detected by an ultrasonic sensor (13) that performs the position detection of the separating element (5) on the side (Continued)

of the media chamber (11) having the compressible fluid. A method for ultrasonic displacement measurement uses that system.

17 Claims, 1 Drawing Sheet

(56) References Cited

U.S. PATENT DOCUMENTS

| | | | | | |
|---|---|---|---|---|---|
| 4,967,600 | A * | 11/1990 | Keller | G01L 19/147 | 338/4 |
| 5,221,894 | A * | 6/1993 | Herwig | G01R 19/16509 | 324/117 R |
| 5,840,061 | A * | 11/1998 | Menne | A61M 5/30 | 604/68 |
| 6,435,031 | B1 * | 8/2002 | Nagai | G01D 5/00 | 310/321 |
| 9,764,094 | B1 * | 9/2017 | Gray | A61M 5/31511 | |
| 2010/0288036 | A1 * | 11/2010 | Volkwein | G01B 17/00 | 73/114.29 |

FOREIGN PATENT DOCUMENTS

| | | |
|---|---|---|
| DE | 103 22 718 | 12/2004 |
| DE | 103 30 914 | 1/2005 |
| DE | 10 2007 035 252 | 2/2009 |
| EP | 0 599 171 | 6/1994 |
| EP | 1 079 119 | 2/2001 |
| WO | 83/03478 | 10/1983 |
| WO | 2005/003571 | 1/2005 |

* cited by examiner

ULTRASONIC DISPLACEMENT MEASUREMENT SYSTEM AND METHOD FOR ULTRASONIC DISPLACEMENT MEASUREMENT

FIELD OF THE INVENTION

The invention relates to an ultrasonic displacement measuring system, in particular for hydraulic accumulators having at least one movable separating element separating two media chambers from each other preferably in a media-tight manner inside a housing. One media chamber holds a compressible or an incompressible fluid. The other media chamber holds a compressible fluid, in particular in the form of a working gas. The particular position of the movable separating element within the housing can be detected by at least one ultrasonic sensor. The invention further relates to a method of ultrasonic displacement measurement by such an ultrasonic displacement measuring system.

BACKGROUND OF THE INVENTION

In hydropneumatic accumulator assemblies or in piston-cylinder assemblies, such as pneumatic working cylinders, in many cases knowing the exact position of the piston in the cylinder is desirable or necessary to be able to control a device. Moreover, knowing in hydropneumatic accumulator assemblies, how much gas is available to build up a back pressure in the accumulator element is important. Since the gas has a tendency to evaporate over time in the direction of the oil side, i.e. from time to time, the gas needs to be refilled, triggering a regular maintenance procedure.

Various solutions have been proposed in the past to determine the position of the piston. For example, installing an ultrasonic displacement measuring system on the oil side of a pressure accumulator is known. Such an ultrasonic single-channel system is sold by marco Systemanalyse and Entwicklung GmbH, Hans-Böckler-Str. 2, 85221 Dachau, Germany, under the name "ps/ulm/esd/a". Sound signals are emitted by an ultrasonic transducer and reflected by a piston. The reflected sound wave is then received again by the ultrasonic transducer. In doing so, the acoustic signal propagates at a known propagation velocity in the oil, permitting the determination of the displacement of the piston from the signal propagation delay using the ultrasonic transducer. The disadvantage of this solution is the significant dependence of the sound propagation on the oil temperature and of gas bubbles undesirably occurring in the oil, for example, due to cavitation. Such gas bubbles affect the propagation of the sound signal, and thus, significantly distort the measurement result.

Furthermore, prior art includes arranging one or more ultrasonic transducers at the outside of a hydraulic piston-cylinder arrangement to be able to recognize in this way if a piston is in the immediate vicinity of the ultrasonic transducer. Such a device is sold by Sonotec Ultraschallsensorik Halle GmbH, Nauendorfer Str. 2, 06112 Halle (Saale), Germany, under the name "Sonocontrol 14". Such devices are especially suitable for limit switches. A continuous position measurement of the piston is not possible in this case, even if several sensors are used at intervals.

SUMMARY OF THE INVENTION

An object of the invention is to provide an improved ultrasonic displacement measuring system and a method for ultrasonic displacement measurement using such a system, rendering displacement measurements reliable, accurate and cost-effective.

The invention is characterized in that the ultrasonic sensor conducts the position detection of the separating element on the side of the other media chamber having the compressible fluid.

This way, the position of the separating element can be detected very precisely, because the ultrasonic signal has to propagate only through a gaseous fluid, such as nitrogen gas. Regardless of the movement of the separating element and the ambient conditions, no phase transitions occur in this compressible gas, i.e. related measurement errors need not be considered. Due to the fact that the compressible fluid is a gas, the usually electrically controlled ultrasonic sensor is always kept dry, i.e. that no impairment due to moisture in the operation of the sensor needs to be feared. The ultrasonic measurement system is therefore durable and low maintenance. The components required for the ultrasonic sensor are also available at relatively low cost, i.e. overall an inexpensive ultrasonic displacement measuring system is illustrated. The position detection of the separating element, preferably in a piston-shaped form, is performed reliably in both static and highly dynamic motion processes using the separating element.

The ultrasonic sensor is advantageously held in a sensor chamber, the interior of which is connected by a media router in a media-carrying manner to the other media chamber having the compressible fluid. This way, the ultrasonic sensor is kept pressure-compensated. No additional measures must be taken to support the sensor in relation to the internal pressure in the other media chamber. Thus, the sensor can be designed lightly and freely suspended, resulting in an advantageously unopposed sound generation and propagation.

According to a preferred embodiment, the ultrasonic sensor is stationary disposed on a lid part of the housing such that at least a part of the sensor chamber having the media router protrudes by a pre-determinable projection into the other media chamber having the compressible fluid. Also, in every movement position of the separating element, the separating element is kept at a distance from the ultrasonic sensor. Consequently, the pressure compensation of the sensor chamber can be performed particularly easily. The sensor chamber may include at least one passage point between the support and the underside of the lid part facing the sensor element, which at least in part forms the media router. Other fluid channels in the adjacent components are not required. Moreover, the position of the ultrasonic wall sensor in this arrangement is optimal in terms of sound propagation because, in particular for a separating element in close proximity to the sensor, no reverberations on other components distort the measurement results.

The sensor chamber may be advantageously sealed by a glass part towards the environment, preferably in the form of a glass feedthrough. The glass feedthrough forms a cable connection from the ultrasonic sensor to a control unit. Such a glass element can be manufactured easily and effectively seals this media chamber from the environment even at the highest pressures in the respective media chamber. Consequently, the sensor signal can be transmitted by the shortest route and using just one cable connection from the ultrasonic sensor to the control unit. Therefore, the signal degradation is minor.

With particular advantage, the ultrasonic sensor has an ultrasonic transducer having a piezoceramic, preferably disc-shaped, which is disposed on a structure. The structure preferably closes off the sensor chamber in the direction of the other media chamber having the compressible fluid. The piezoceramic can be arranged in such a manner that it expands or contracts in the radial direction depending on the applied voltage. Bending stress due to a full-surface bonding of the piezoceramic and the structure is then applied, making the structure bulge. By appropriate excitation of the piezoceramic, an ultrasonic wave can be created in the compressible fluid of the other media chamber. The principle of action can be reversed if the structure is subjected to vibrations due to sound waves, causing deflections of the same. These vibrations are then transmitted to the piezoelectric element in the form of expansions or contractions, which are converted into electrical voltages, which can be evaluated using suitable control electronics.

Advantageously, a reference measuring section is present within the compressible medium, which is delimited by two reference points preferably arranged stationary in relation to each other. One reference point is formed by the ultrasonic sensor. The other reference point is from a preferably stationary reflection point for the sensor signal, which has preferably the shape of a boundary wall of the sensor chamber. Due to the reference section, the propagation delay of the sound signal from the ultrasonic sensor to the separating element and simultaneously the propagation delay of the same sound signal along the reference measuring section can be measured. This way, the sound propagation velocity in the fluid of the other media chamber can be measured in the reference measuring section, which can then be used to determine the position of the separating element on the basis of the signal propagation delay and the current propagation velocity. In that respect, particularly advantageously the measuring section is located between the ultrasonic sensor and the separating element on the opposite side of the reference section in relation to the ultrasonic sensor. Therefore, the measuring sections do not interact. Also, no reference object has to be arranged in the sound path between the ultrasonic sensor and the separating element, which could distort the measurement result due to interference. Furthermore, there is also no risk that the subcomponent strikes against the reference object and damages it that way. The boundary wall may have the form of a step in the sensor chamber. In doing so, a non-uniform boundary wall was demonstrated to be is sufficient for determining the sound propagation velocity.

Particularly advantageously, the separating element is formed of a rigid limiting piston, which is movably arranged within the housing in the direction of its longitudinal axis. The ultrasonic sensor is arranged coaxially to that longitudinal axis. Thus, the separating element can only move in one dimension, which greatly simplifies the design of the ultrasonic displacement measuring system and sources of errors are excluded. The quality of the reflected sound signal is also improved this way.

Advantageously, the separating element, has, preferably in the form of a limiting piston, a collecting device for incompressible fluid. During the operation of the ultrasonic displacement measuring system, the collecting device penetrates from the media chamber having the incompressible fluid through a gap between the limiting piston and the housing into the other media chamber having the compressible fluid. The collecting device, preferably in the form of a reservoir in the limiting piston, is arranged adjacent opposite the ultrasonic sensor in the direct sound-emitting direction. This way, the incompressible fluid that has penetrated into the other media chamber is collected in the collecting device.

The measuring section is then shortened between the ultrasonic sensor and the separating element, as the incompressible fluid forms a first reflecting surface due to the phase change. However, one part of the ultrasonic wave penetrates further into the incompressible fluid and is then reflected by the bottom of the separating element. This way, over time, the amount of fluid that has accumulated in the reservoir can be determined. Thus, whether the ultrasonic displacement measuring system and the pressure accumulator, respectively, in which the ultrasonic displacement measuring system is arranged, can reliably detect the need to be serviced.

The operating frequency of the ultrasonic sensor may be selected between a frequency that is as low as possible, in particular 100 kHz, in which a small wave-dependent amplitude modulation occurs due to dispersion, and a comparatively higher frequency, in particular 150 kHz, permitting a higher resolution of the displacement measurement at a lower wavelength. At these frequencies, the sound signal has a wavelength of approx. 40 mm, i.e. the position of the separating element can be determined very accurately. At least the measurement accuracy is much higher than in the known displacement measuring systems.

According to the process according to the invention, an acoustic signal is emitted by the ultrasonic sensor. The sound reverberations at the separating element and at a reference point opposite the ultrasonic sensor are detected. The sound propagation velocity in the compressible fluid is determined from the propagation delay of the sound signal from the ultrasonic sensor to the assignable reference point and back. From this sound propagation velocity and the propagation delay of the sound signal from the ultrasonic sensor to the separating element and back, the respective distance of the movable separating element from the stationary ultrasonic sensor is then determined.

The propagation delays on the measuring section and the reference measuring section can be measured simultaneously or staggered. In particular, a simultaneous measurement improves the measurement accuracy, as during a fast movement of the separating element during a stroke, when an adiabatic process of the compressible fluid may occur in the other media chamber. Its temperature may increase, for instance that may alter the sound propagation velocity, and thus, impair the measurement accuracy.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figures 1, 2:
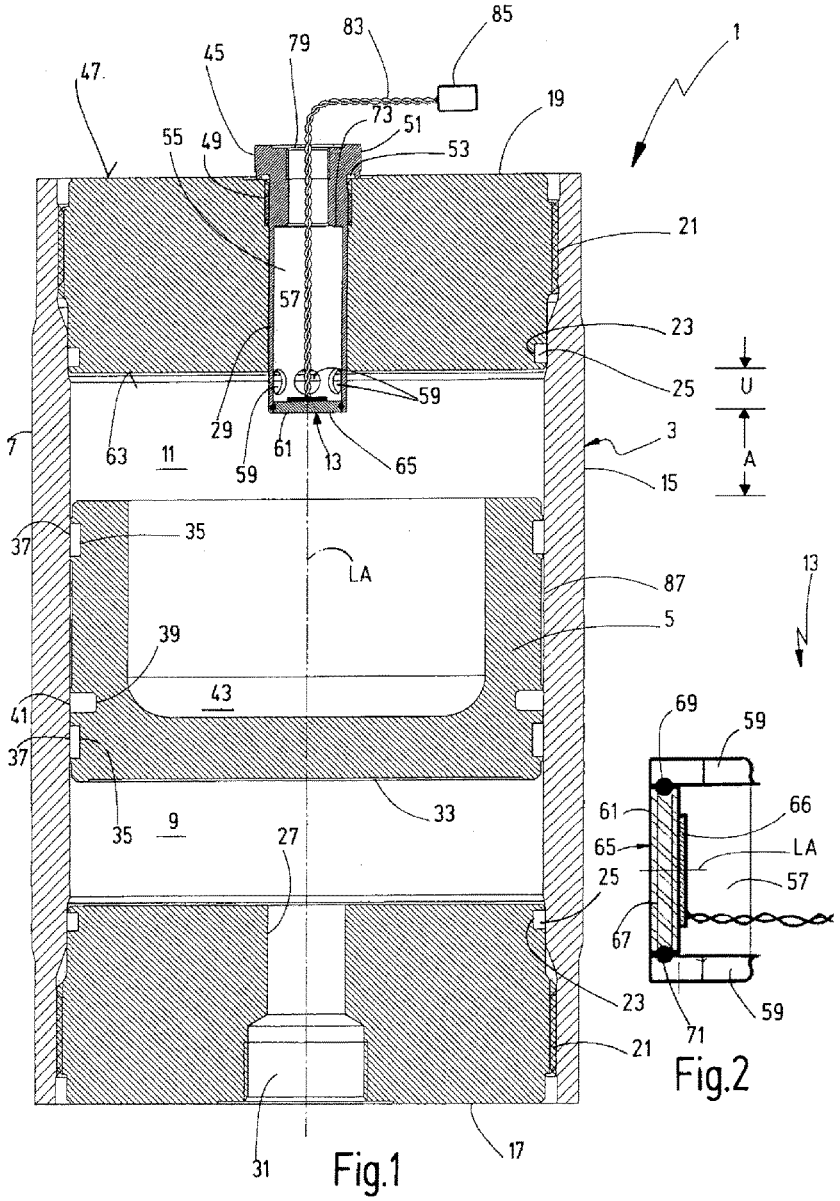
FIG. 1 is a side view in section of a pressure accumulator having an ultrasonic displacement measuring system according to an exemplary embodiment of the invention.
FIG. 2 is an enlarged and partial side view in section of the ultrasonic sensor of FIG. 1.

In FIG. 1, an ultrasonic displacement measuring system 1 is shown with a hydraulic accumulator 3 having at least one movable separating element 5, separating first and second media chambers 9, 11 from each other within a housing 7 in a largely media-tight manner. The first media chamber 9 receives an incompressible fluid, in particular in the form of hydraulic oil. The second media chamber 11 receives a compressible fluid, in particular in the form of a working gas, here nitrogen ($N_2$). Another compressible fluid can be introduced in the first media chamber 9, for example, in the form of methane or inert gases. Other incompressible fluids, such as alcohols, or even pasty fluid media can be introduced in the first media chamber 9. The respective position of the movable separating element 5 inside the housing 7 can be detected by an ultrasonic sensor 13.

In FIG. 1 the housing 7 has a tubular housing part 15, into which two end lid portions 17, 19 have been screwed via threaded sections 21. The lid parts 17, 19 are sealed by gaskets 25 retained in circumferential grooves 23 against the tubular housing part 15. The two lid parts 17, 19 have coaxial bores 27, 29, whereby the lid part 17, which leads to the first media chamber 9 having the incompressible fluid, has a terminal 31 for a fluid line (not shown in detail) of a hydraulic circuit.

The separating element 5 is located between the lid parts 17, 19. The separating element 5 is formed of a rigid limitation piston arranged movably in the direction of its longitudinal axis LA within the housing 7. The limiting piston 5 has a shaped of a pot, whereby a bottom 33 points in the direction of the first media chamber 9. Two grooves 35, in which guide rings 37 are arranged, are arranged at a certain distance from each other along the peripheral side of the limiting piston 5. A further circumferential groove 39, in which a sealing element 41 is arranged, is provided between the guide rings 37. The separating member 5 is formed to increase the storage reservoir of gaseous and insofar compressible fluid in the manner of a pot or trough and has a collecting device 43 on the bottom side for the incompressible fluid, which may inadvertently arrive at the gaseous side from the oil side of the accumulator via the sealing device having a sealing element 41. The collecting device 43 is shaped insofar in the form of a reservoir coaxial to the longitudinal axis LA in the limiting piston 5. This collecting device 43 is thus arranged adjacent opposite or facing the ultrasonic sensor 13 in its direct sound-emitting direction.

A sleeve-shaped sensor holder 45 is inserted, in particular screwed, in the lid part 19 adjacent to the second media chamber 11. The sensor holder 45 has adjacent to the outer side 47 of the lid part 19 a threaded segment 49 and an enlarged head 51. An annular sealing element 53 is provided between the head 51 and the lid part 19. On the inside 55 the sensor holder 45 is hollow to form a sensor chamber 57. The inside 55 of the sensor chamber 57 is connected by a media channel 59 in a media-carrying manner or in fluid communication to the second media chamber 11 having the compressible fluid in the form of the working gas. For this purpose, the sensor chamber 57 has multiple passage points 59 in the form of bores between a structure 61 of the ultrasonic sensor 13 and the bottom side 63 of lid element 19 facing the separating element.

In the lid part 19 adjacent to or at one end of the second media chamber 11, the ultrasonic sensor 13 is held in the sensor holder 45. The ultrasonic sensor 13 performs its position detection of the separating element 5 on the side of the second media chamber 11 having the compressible fluid. The ultrasonic sensor 13 is arranged coaxially to the longitudinal axis LA of the housing 7. Its end is held in the sensor chamber 57. The ultrasonic sensor 13 is arranged stationary on the lid part 19 in such a manner that at least part of the sensor chamber 57 having the media router 59 protrudes by a predetermined projection U into the second media chamber 11 having the compressible fluid. In every traversing position of the separating element 5, sensor 13 is kept at a distance from the separating element 5. As a result, the ultrasonic sensor 13 is held pressure-compensated in the second media chamber 11. In particular, the sensor 13 can also be held in the top dead center of the piston-shaped separating element 5 in the pot-shaped recess of the separating element 5 having the collecting device 43, without risk of being struck, and in doing so conduct sensor measurements.

The ultrasonic sensor 13, which is shown in more detail in FIG. 2, has an ultrasonic transducer 65 with a disc-shaped piezoceramic 66 disposed on the likewise disc-shaped structure 61 by full-surface bonding. The structure 61 seals the sensor chamber 57 from the second media chamber 11 having the compressible fluid. To this end, the support 61 has a circumferential groove 67. Support 61 is securely held via an o-ring 69 located in an inner circumferential groove 71 of the sensor chamber 57. Due to electrical excitation, the piezoceramic 66 can expand or contract radially and transfer this change in length to the structure 61, resulting in a periodic deflection of the structure 61, which in particular bulges and that way produces the desired sound wave.

The second media chamber 11 contains a reference measuring section inside the sensor chamber. The reference measuring section is delimited by two reference points 13, 73, arranged stationary in relation to each other. One or first reference point is the ultrasonic sensor 13 itself. The other or second reference point is a reflection point 73 for the sensor signal. This second reflection point 73 is formed by a boundary wall, here a step in the inner wall of the sensor chamber 57. The reflection point 73 and the separating element 5 are thus arranged advantageously on opposite sides of the ultrasonic sensor 13. The measuring section and the reference section are therefore independent of each other. In addition, the reflection point 73 is provided at a protected location, preventing any influence on part of the separating element 5.

The sensor chamber 57 is covered in the direction of the environment by a glass part 79, preferably in the form of a glass feedthrough. The ultrasonic sensor 13 is connected to a control unit 85 through the glass part 79 via a cable connection 83.

The ultrasonic sensor 13 is operated at a pre-determinable operating frequency. This frequency can be selected between a low frequency and a comparatively higher frequency. The lower frequency is chosen so that a small wave-dependent amplitude modulation, and therefore little dispersion, occurs, and is particularly 100 kHz. At the higher frequency, a higher resolution is possible for the displacement measurement due to the shorter wavelength. The higher frequency is preferably 150 kHz.

The functionality of the ultrasonic displacement measuring system 1 according to the invention is explained below. The ultrasonic displacement measuring system 1 is arranged in a hydropneumatic pressure accumulator 3. Due to the storage of an incompressible or compressible medium in the first media chamber 9, the separating element 5 is moved inside the pressure accumulator 3, to provide pressure compensation between the fluids in the two media chambers 9, 11. Meanwhile, the position of the separating element 5 can be determined using the ultrasonic displacement measuring system 1. For this purpose, a sound signal, controlled by the control unit 85, is emitted by the ultrasonic sensor 13. The reverberations at the separating element 5 and at the ultrasound sensor 13 opposite reference point 73 are detected, resulting in the propagation delays of reflected sound waves being determinable using the control unit 85. The sound propagation velocity in compressible fluid of the second media chamber 11 is determined from the propagation delay of the sound signal from the ultrasonic sensor 13 to the assignable reference point 73 and back. From this sound propagation velocity and the propagation delay of the sound signal from the ultrasonic sensor 13 to the separating element 5 and back, the respective distance A of the movable separating element 5 from the stationary ultrasonic sensor 13 can then be determined.

If liquid was to penetrate from the first media chamber 9 having the incompressible fluid through a gap 87 between the separating element 5 and housing 7 into the second media chamber 11, it would flow into the collection device 43. There, it shortens the measuring section between the ultrasonic sensor 13 and the separating element 5. As, however, part of the ultrasonic wave continues to be reflected at the bottom of the separating element, the ultrasonic displacement measuring system 1 according to the invention can be advantageously used to determine whether and how much liquid has penetrated into the second media chamber. This determination includes the no longer sufficient tightness of the sealing system 41 of the separating piston 5 and triggers in this respect a regular maintenance of the accumulator or even its exchange in the connected hydraulic circuit (not shown).

The invention thus presents a particularly advantageous ultrasonic displacement measuring system 1. By measuring at the gas side 11, the position of the separating element 5 can be detected very precisely, because the ultrasonic signal has to propagate only through a fluid. Regardless of the movement of the separating element 5 and the ambient conditions, no phase transitions occur in this compressible fluid, i.e. related measurement errors need not be considered. Due to the fact that the compressible fluid usually is a gas, the electrically controlled ultrasonic sensor 13 is always stored in a dry environment, i.e. during operation no impairment of the ultrasonic sensor 13 by moisture needs to be feared. The ultrasonic measurement system 1 is therefore durable and low maintenance. The components required for the ultrasonic sensor 13 are also available at relatively low cost. The minimum displacement measuring section for the sensor 13 is formed by the bottom dead-center position of the piston-shaped separating element 5, as soon as this comes into contact with the upper surface of the lower lid part 19 facing the separating elements 5.

The solution according to the invention can on its merits also be used for pneumatic power cylinders (not shown), in which the two media chambers 9, 11 are separated from each other by a piston-rod unit. The rod of the respective unit is guided to the outside at one lid side for linking to third components. The two media chambers 9, 11 can be alternately connected to a pneumatic supply to reciprocate the piston-rod unit.

While one embodiment has been chosen to illustrate the invention, it will be understood by those skilled in the art that various changes and modifications can be made therein without departing from the scope of the invention as defined in the claims.

The invention claimed is:

1. An ultrasonic displacement measuring system, comprising:

a housing with first and second media chambers, said first media chamber having a compressible or incompressible fluid therein, said second media chamber having a compressible fluid therein;

a separating element movably mounted in said housing and separating said first and second media chambers from one another; and a stationary ultrasonic sensor being in said housing and detecting positions of said separating element in said housing on a side of said separating element exposed in said second media chamber, said ultrasonic sensor being held in an inside of a sensor holder with a sensor chamber connected in fluid communication with said second media chamber through a media channel in said sensor holder and being exposed on opposite first and second sides thereof to equal pressures in said sensor chamber and in said second media chamber, respectively.

2. An ultrasonic displacement measuring system according to claim 1 wherein said compressible fluid in said second media chamber is a working gas.

3. An ultrasonic displacement measuring system according to claim 1 wherein said sensor chamber is separated from an environment outside said housing and said ultrasonic sensor by a glass part.

4. An ultrasonic displacement measuring system according to claim 3 wherein said glass part comprises a feedthrough mounting a cable connection from said ultrasonic sensor to a control unit.

5. An ultrasonic displacement measuring system according to claim 1 wherein said ultrasonic sensor is disposed stationary on a lid part of said housing such that a part of said sensor chamber with said media channel protrudes by a pre-determinable projection into said second media chamber; and in each position of said separating element, said separating element is maintained at a distance from said ultrasonic sensor.

6. An ultrasonic displacement measuring system according to claim 1 wherein said ultrasonic sensor comprises an ultrasonic transducer having a piezoceramic disc, said piezoceramic disc being disposed on a structure.

7. An ultrasonic displacement measuring system according to claim 6 wherein said structure seals an end of said sensor chamber in a direction of said second media chamber.

8. An ultrasonic displacement measuring system according to claim 6 wherein said sensor chamber is separated from an environment outside said housing and said ultrasonic sensor by a glass part; and said media channel is between said structure and said glass part.

9. An ultrasonic displacement measuring system according to claim 1 wherein a reference measuring section is present within said compressible fluid of said second media chamber and is delimited by first and second reference points, said first reference point being formed by said ultrasonic sensor, said second reference point being a reflection point.

10. An ultrasonic displacement measuring system according to claim 9 wherein said first and second reflection points are stationary relative to one another.

11. An ultrasonic displacement measuring system according to claim 10 wherein said second reference point has a shape of a boundary wall of said sensor chamber.

12. An ultrasonic displacement measuring system according to claim 1 wherein said separating element is a rigid limiting piston movable in said housing along a longitudinal axis of said housing, said ultrasonic sensor being arranged coaxial to said longitudinal axis.

13. An ultrasonic displacement measuring system according to claim 1 wherein said first media chamber has an incompressible fluid therein; and said separating element is a rigid limiting piston and comprises a collecting device for said incompressible fluid penetrating from said first media chamber through a gap between said limiting piston and said housing into said second media chamber during operation of the ultrasonic displacement measuring system, said collection device being adjacent and opposite said ultrasonic sensor in a direct sound-emitting direction thereof.

14. An ultrasonic displacement measuring system according to claim 13 wherein said collecting device comprises a reservoir in said limiting piston.

15. An ultrasonic displacement measuring system according to claim 1 wherein said ultrasonic sensor has an operating frequency between a low frequency having a small wave-dependent amplitude modulation occurring due to dispersion and a comparatively higher frequency permitting a higher resolution of displacement measurement at a lower wavelength.

16. An ultrasonic displacement measuring system according to claim 15 wherein said low frequency is 100 kHz; and said higher frequency is 150 kHz.

17. A method of ultrasonic displacement measurement using an ultrasonic displacement measuring system having a housing with first and second media chambers with a compressible or incompressible fluid and a compressible fluid therein, respectively, having a separating element movably mounted in the housing and separating the first and second media chambers from one another, having a stationary ultrasonic sensor being in the housing and detecting positions of the separating element in the housing on a side of the separating element exposed in the second media chamber with the ultrasonic sensor being held in an inside of a sensor holder with a sensor chamber connected in fluid communication with the second media chamber through a media channel in the ultrasonic sensor holder and being exposed on opposite first and second sides thereof to equal pressures in said sensor chamber and in said second media chamber, respectively, the method comprising steps of:

emitting an acoustic signal by the ultrasonic sensor;

detecting reverberations at the separating element and at a reference point opposite the ultrasonic sensor;

determining a sound propagation velocity in the compressible fluid in the second media chamber from a propagation delay of the acoustic signal from the ultrasonic sensor to the reference point and back; and determining a distance of the separating element from the ultrasonic sensor from the sound propagation velocity and the propagation delay of the acoustic signal from the ultrasonic sensor to the separating element and back.

* * * * *